US005211547A

United States Patent [19]

Gaston et al.

[11] Patent Number: 5,211,547

[45] Date of Patent: May 18, 1993

[54] FUEL PUMP AND FUEL SENDER ASSEMBLY

[75] Inventors: Robert D. Gaston, Dearborn Heights; Earle F. Cox, Bloomfield Hills, both of Mich.

[73] Assignee: Ford Motor Company, Dearborn, Mich.

[21] Appl. No.: 716,580

[22] Filed: Jun. 17, 1991

[51] Int. Cl.[5] ..... F04B 17/00; F04B 35/04; A47G 1/10

[52] U.S. Cl. ..... 417/360; 417/423.3; 417/423.15; 248/316.7; 248/215

[58] Field of Search ..... 417/360, 423.3, 423.15; 248/300, 312, 316.7, 692, 222.1, 215, 301, 225.2, 224.3

[56] References Cited

U.S. PATENT DOCUMENTS

| | | | |
|---|---|---|---|
| 2,282,243 | 5/1942 | Rambo et al. . | |
| 2,312,526 | 3/1943 | Curtis . | |
| 2,546,034 | 3/1951 | Lansing . | |
| 3,074,347 | 1/1963 | Clymer . | |
| 3,418,991 | 12/1968 | Schultz et al. . | |
| 3,565,384 | 2/1971 | Lockwood | 248/312 |
| 3,659,965 | 5/1972 | Ebert et al. . | |
| 3,969,043 | 7/1976 | Bright et al. . | |
| 4,247,070 | 1/1981 | Dirksing | 248/215 |
| 4,362,476 | 12/1982 | Kemmner et al. . | |
| 4,521,164 | 6/1985 | Tuckey | 417/310 |
| 4,716,931 | 1/1988 | Shibamoto . | |
| 4,726,742 | 2/1988 | Harbison et al. | 417/360 |
| 4,734,008 | 3/1988 | Roth . | |
| 4,844,704 | 7/1989 | Jiro | 417/423.3 |
| 5,015,159 | 5/1991 | Mine et al. | 417/423.7 |
| 5,044,526 | 9/1991 | Sasaki et al. | 417/360 |

OTHER PUBLICATIONS

1988 Scorpio Shop Manual, Ford Motor Company, Feb. 1987, p. 24–35–8.

1992 Ford Probe Service Manual, Ford Motor Company, p. 10–01A–7.

1992 Ford Escort/Tracer Service Manual, Ford Motor Company, p. 10–01–8.

*Primary Examiner*—Richard A. Bertsch
*Assistant Examiner*—Alfred Basichas
*Attorney, Agent, or Firm*—Damian Porcari; Roger L. May

[57] ABSTRACT

A fuel tank assembly has a reservoir mounted to the bottom wall of a fuel tank, with a fuel pump unit and fuel sender unit both mounted to the reservoir. The fuel pump unit is removably mounted to the reservoir by a fuel pump bracket and the fuel sender unit is removably mounted to the reservoir by a fuel sender bracket The reservoir, fuel pump bracket and fuel sender bracket can be composed of materials compatible with alcohol fuels or other fuel compositions.

22 Claims, 3 Drawing Sheets

FUEL PUMP AND FUEL SENDER ASSEMBLY

FIELD OF THE INVENTION

The present invention relates generally to assemblies for mounting within fuel tanks and to methods for assembling the fuel tank assemblies.

BACKGROUND OF THE INVENTION

Fuel pump units are typically installed within fuel tanks of automobiles to pump fuel from the fuel tank to an engine, while fuel sender units are typically installed within fuel tanks to gauge the level of fuel within the fuel tank. Generally, fuel pump units may be attached directly to an interior wall of a fuel tank. Such a fuel pump unit is discussed in U.S. Pat. No. 2,282,243, wherein a fuel pump is positioned at the periphery of a depression in a bottom interior wall of a fuel tank. An intake inlet of the fuel pump extends into the depression. A fuel sender unit is discussed in U.S. Pat. No. 3,418,991. The fuel sender unit of that patent is suspended from the top of a fuel tank.

Agitation of the fuel tank may result in sloshing of fuel away from a fuel pump intake inlet thereby interrupting supply of fuel to the engine. This is most likely to occur when the level of fuel within the fuel tank is low. Furthermore, maintenance of the fuel pump unit and the fuel sender unit may be required should either unit fail to perform adequately. It would therefore be desirable to improve the ability of the fuel pump unit to supply fuel to the engine without interruption. It would further be desirable to easily remove the fuel pump unit and the fuel sender unit from the fuel tank so that they may be serviced.

BRIEF SUMMARY OF THE INVENTION

Fuel tank assemblies in accordance with embodiments of the present invention relate to a reservoir mounted to a bottom of a fuel tank, with a means for pumping fuel ("fuel pump unit"), and a means for gauging the level of fuel ("fuel sender unit"), both mounted to the reservoir. According to a certain preferred embodiment, the reservoir may be unitary with the fuel tank, for example, as is generally taught by U.S. Pat. No. 4,708,170. According to a further certain preferred embodiment, the fuel pump unit and the fuel sender unit may be removably mounted to the reservoir.

Embodiments of the present invention contemplate retaining a portion of fuel within an area defined by the reservoir surrounding an intake inlet of the fuel pump unit increasing the ability of the fuel pump unit to continuously supply fuel to an engine. The fuel pump unit and the fuel sender unit are preferably removably mounted to the reservoir to improve their removal should they require maintenance.

The invention also contemplates a method of assembling a fuel tank assembly as described above utilizing removable mounting means enabling a fuel pump unit and a fuel sender unit to be easily removed and serviced when needed. In accordance with the method of the present invention, a reservoir is secured to the bottom of a fuel tank. The fuel sender unit is removably mounted to the reservoir. The fuel pump unit is then removably mounted to the reservoir as well.

It is accordingly an object of the present invention to provide a fuel tank assembly for placement within a fuel tank.

Other features and advantages of the present invention will become apparent from the subsequent description and the appended claims taken in conjunction with the accompanying drawings.

DETAILED DESCRIPTION OF CERTAIN PREFERRED EMBODIMENTS

Figure 1:
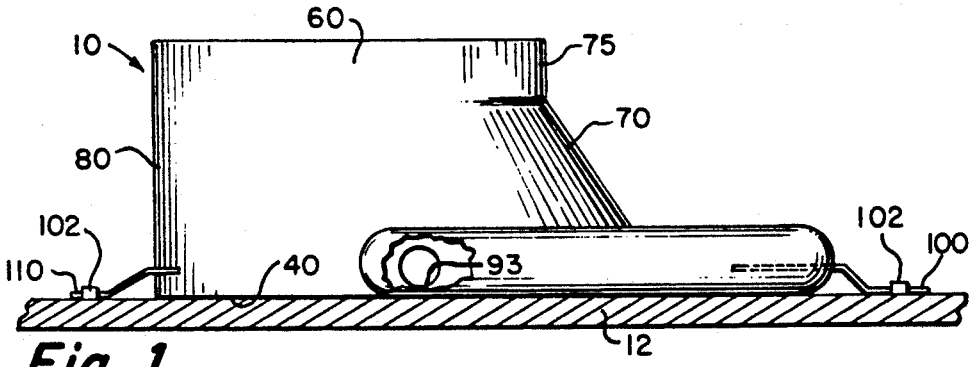
FIG. 1 is a side view of a fuel reservoir in accordance with an embodiment of the present invention.
Figure 2:
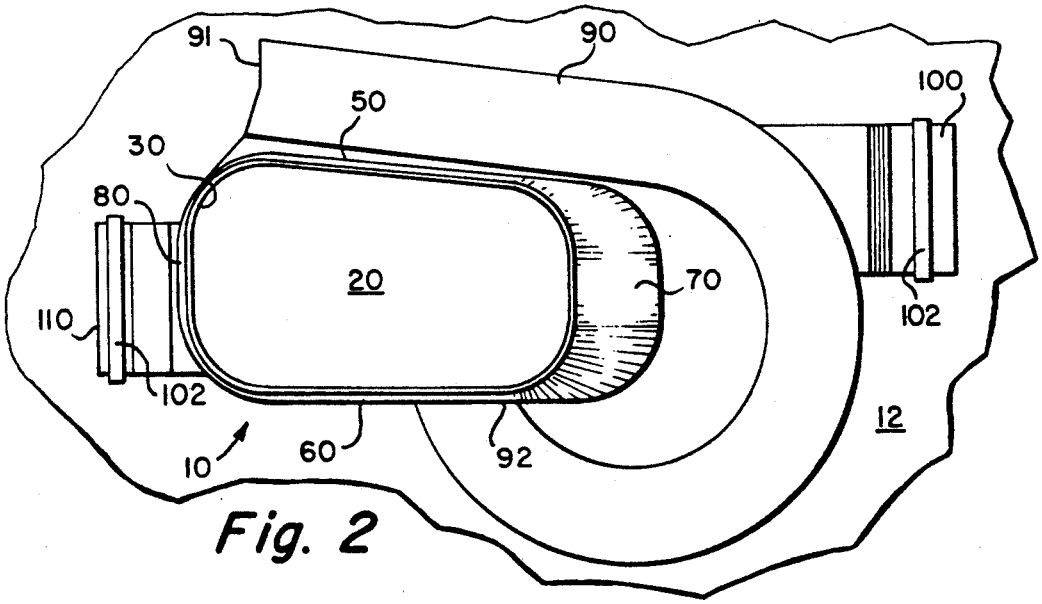
FIG. 2 is a top view of the reservoir of FIG. 1.

Referring to FIGS. 1 and 2, a preferred embodiment of a reservoir is seen to be generally indicated at 10. Reservoir 10 is generally boot-shaped in design defining reservoir interior 20 and having reservoir opening 30 which communicates reservoir interior 20 with an interior of fuel tank 12. Reservoir 10 is preferably boot shaped to provide an area where sloshing of fuel due to agitation of a fuel tank is minimized, however, alternate reservoir designs will be apparent to those skilled in the art in view of the present disclosure.

As indicated in FIGS. 1 and 2, reservoir 10 has substantially planar bottom wall section 40 integral or preferably unitary with side wall sections 50 and 60 which extend substantially vertically therefrom. Front wall section 70 is integral or preferably unitary with bottom wall section 40 and side wall sections 50 and 60. Front wall section 70 is angled toward back wall section 80 which is integral or preferably unitary with side wall sections 50 and 60 and bottom wall section 40. Back wall section 80 extends substantially vertically from bottom wall section 40. Front wall section 70 terminates at reservoir opening 30 in a vertical fashion as indicated generally at 75, and not in an angled fashion. Front wall section 70, side wall sections 50 and 60 and back wall section 80 cooperate to form reservoir opening 30.

Fuel passage 90 is comprised of a conduit, preferably of tubular design, having first opening 91 near back wall section 80 and bottom wall section 40. Fuel passage 90 wraps around side wall section 50, front wall section 70, and engages side wall section 60 as indicated in FIG. 2 at second opening 92. Second opening 92 communicates with opening 93 in side wall section 60 providing fluid communication for a flow of fuel through fuel passage 90 into interior 20 of reservoir 10. Alternative fuel passage designs will be apparent to those skilled in the art in view of the present disclosure.

Referring still to FIGS. 1 and 2, mounting means 100 and 110 are protrusions for fixedly mounting reservoir 10 to fuel tank 12. Preferably, reservoir 10 is fixedly mounted to a bottom wall of fuel tank 12. The protrusions seen in FIGS. 1 and 2 extend from fuel passage 90 and back wall section 80, however they may extend from any part of reservoir 10 sufficient to secure reservoir 10 to fuel tank 12. Both mounting means 100 and 110 extend in parallel fashion with bottom wall section 40 and exterior to reservoir interior 20. Mounting means 100 and 110 are secured to fuel tank 12 by any suitable securing means. FIGS. 1 and 2 show fittings 102 which engage mounting means 100 and 110 and are fixedly secured to fuel tank 12. Alternative mounting means will be apparent to those skilled in the art in view of the present disclosure.

An alternate mounting means contemplated by the invention comprises a plurality of stakes which are integral or preferably unitary with bottom wall section 40 and extend perpendicularly to bottom wall section 40 and exterior to fuel tank interior 20. The stakes may be inserted into passages in fuel tank 12 and then secured either by heating to a point where they become integral with fuel tank 12 or by any suitable securing means. It is to be understood that embodiments of the present invention may utilize a combination of the mounting means previously discussed. According to a certain preferred embodiment, reservoir 10 may be unitary with fuel tank 12, for example, as is generally taught by U.S. Pat. No. 4,708,170.

Figure 5:
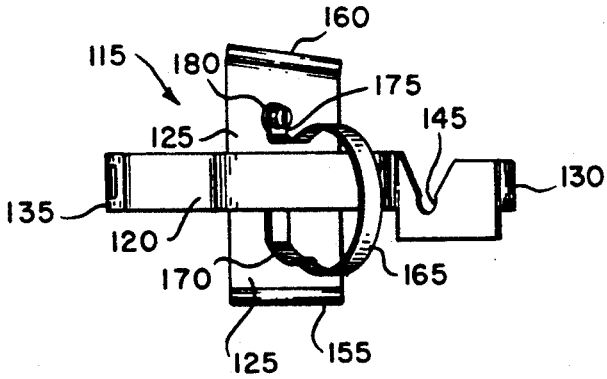
FIG. 5 is a top view of the fuel pump bracket of FIGS. 3 and 4.
Figure 3:
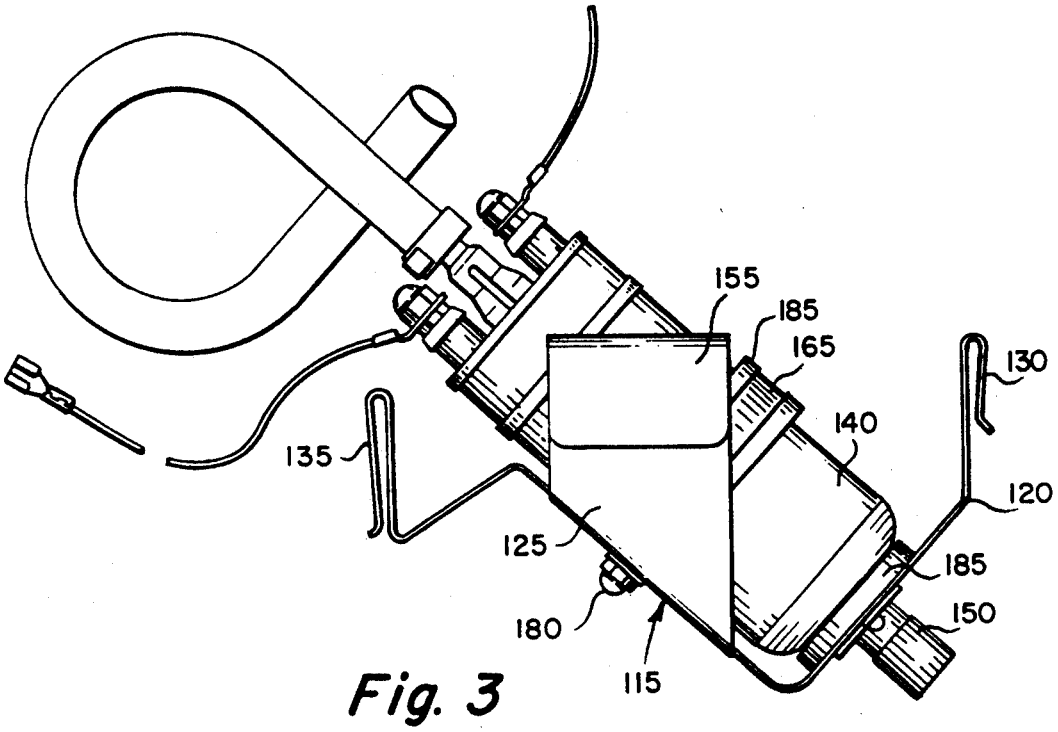
FIG. 3 is a side view of a fuel pump unit secured to a fuel pump bracket in accordance with an embodiment of the present invention.
Figure 4:
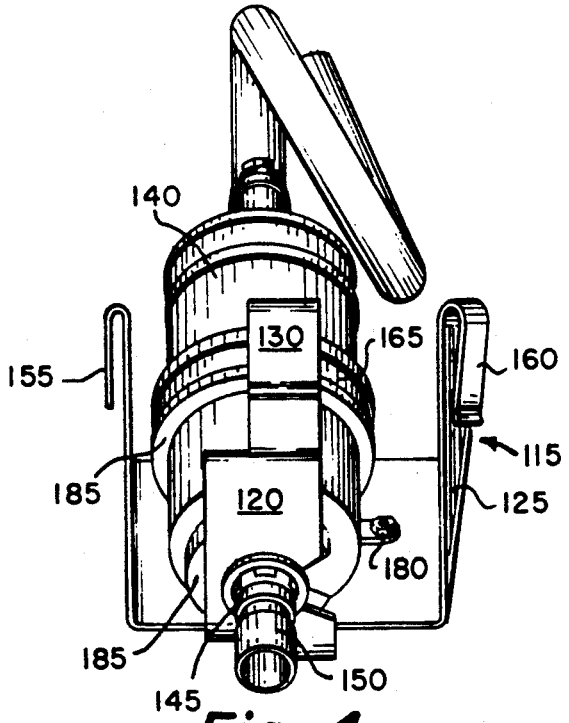
FIG. 4 is a front view of the fuel pump unit and fuel pump bracket of FIG. 3.

Referring to FIGS. 3 and 4, a fuel pump bracket is seen to be generally indicated at 115, engaging a fuel pump unit seen to be generally indicated at 140 in accordance with an embodiment of the invention. Alternative fuel pump units will be apparent to those skilled in the art in view of the present disclosure. Referring to FIG. 5, a fuel pump bracket is seen to be generally indicated at 115. Fuel pump bracket 115 is comprised of a cradle means for supporting fuel pump unit 140 either unitary in design or comprised of a first section 120 and a second section 125 fixedly mounted to one another. Preferably, first section 120 may be welded to second section 125. First section 120 is generally L-shaped and having support means comprising front support means 130 and back support means 135. Front support means 130 comprises an essentially inverted U-shaped clasp which attaches to front wall section 75 at reservoir opening 30. Back support means 135 comprises an essentially inverted U-shaped clasp which attaches to back wall section 80 at reservoir opening 30. As can be seen in FIGS. 4 and 5, first section 120 is provided with opening 145 through which fuel pump intake inlet 150 extends.

As can be seen in FIGS. 3, 4 and 5, second section 125 is fixedly mounted to first section 120. Preferably, first section 120 and second section 125 are welded together. Second section 125 has support means comprising side support means 155 and 160 which comprise essentially inverted U-shaped clasps which attach to side wall sections 50 and 60, respectively, at reservoir opening 30. Inverted U-shaped clasps 130, 135, 155, and 160 may be either permanently attached to reservoir 10 or are preferably removably mounted to reservoir 10 allowing the removal of fuel pump bracket 115 from reservoir 10. It is to be understood that U-shaped clasps 130, 135, 155 and 160 attach to reservoir 10 whether reservoir 10 is bottom mounted to fuel tank 12 or unitary with fuel tank 12. Inverted U-shaped clasps 130, 135, 155, and 160 may be provided with a spring clip mechanism of the type described in U. S. Pat. No. 4,873,865 for removably locking inverted U-shaped clasps 130, 135, 155 and 160 to reservoir 10.

Referring to FIG. 5, fuel pump unit 140 is secured to fuel pump bracket 115 by strap means 165 having first strap means end 170 fixedly mounted to fuel pump bracket 115 and having second strap means end 175 removably mounted to fuel pump bracket 115 by bolt 180. Strap means 165 may be comprised of a flexible material designed to contour fuel pump unit 140 or may be a rigid circular clamp designed to engage fuel pump unit 140. Fuel pump unit 140 may be removed from fuel pump bracket 115 by disengaging second strap means end 175 from fuel pump bracket 115 by removing bolt 180.

Referring to FIGS. 3 and 4, fuel pump bracket 115 may have vibration damping means for reducing the transmission of vibrations to fuel pump unit 140. In a preferred embodiment, vibration damping means comprise resilient bumpers positioned between fuel pump bracket 115 and fuel pump unit 140 at locations where fuel pump bracket 115 supports fuel pump unit 140. Resilient bumpers located generally at 185 cushion fuel pump unit 140.

Fuel pump bracket 115 cradles fuel pump unit 140 in a position suspended from reservoir 10 at opening 30 and into reservoir interior 20 by essentially inverted U-shaped clasps 130, 135, 155, and 160. Inverted U-shaped clasps 130, 135, 155 and 160 are positioned substantially equidistant from each other when attached to reservoir opening 30 and are preferably designed to compliment the geometry of reservoir opening 30. Embodiments of the present invention contemplate L-shaped first section 120 being positioned either perpendicularly to bottom wall section 40 thus supporting fuel pump unit 140 in an upright position, or slanted as indicated in FIG. 3 thereby supporting fuel pump unit 140 in a slanted or angled position. Fuel pump unit 140 is preferably suspended in a position within reservoir 10 where sloshing of fuel is minimized thereby increasing the ability of fuel pump unit 140 to continuously supply fuel to an engine. In a preferred embodiment, fuel pump unit 140 is suspended at an angled or slanted position with fuel pump intake inlet 150 angled towards front wall section 70 and approximately 10 millimeters from bottom wall section 40 of reservoir 10. It is to be understood that this is a preferred orientation, and that alternative orientations will be apparent to those skilled in the art in view of the present disclosure such as fuel pump unit 140 being suspended by fuel pump bracket 115 in an upright manner or slanted with fuel pump intake inlet 150 pointed towards side wall sections 50 or 60 or back wall section 80.

Figure 6:
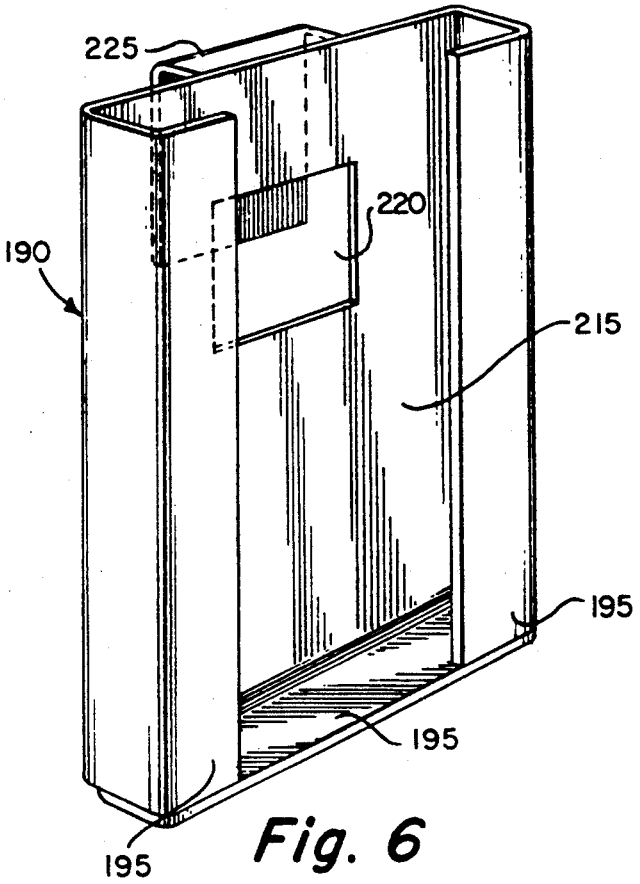
FIG. 6 is a front perspective view of a fuel sender bracket in accordance with an embodiment of the present invention.
Figure 7:
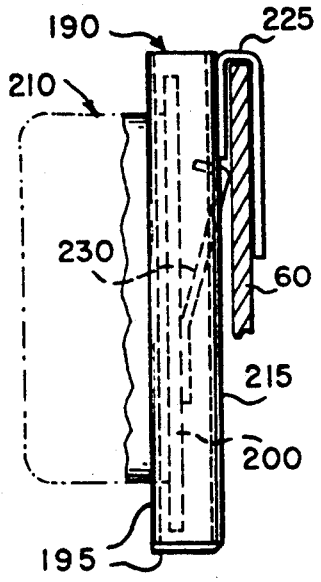
FIG. 7 is a side view partially in cross section of the fuel sender bracket of FIG. 6 showing in phantom a plate attached to a fuel sender unit and a spring clip mechanism.
Figure 8:
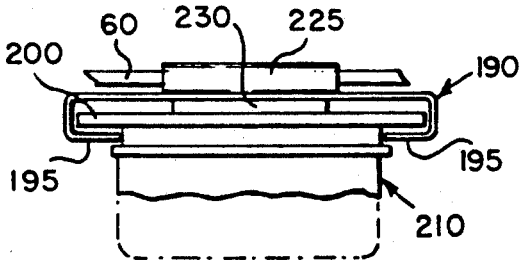
FIG. 8 is a top view of the fuel sender bracket of FIG. 7 engaging a plate attached to a fuel sender unit and having a spring clip mechanism.

Referring to FIG. 6, a fuel sender bracket in accordance with an embodiment of the present invention is seen to be generally indicated at 190. Fuel sender bracket 190 is essentially rectangular in design and comprises slot frame 195, back plate 215, opening 220 and mounting means 225. Referring to FIGS. 7 and 8, plate 200 is attached to fuel sender unit generally indicated at 210 and slidably engages slot frame 195. Alternative fuel sender units will be apparent to those skilled in the art in view of the present disclosure. Spring clip mechanism 230 may be of the type disclosed in U.S. Pat. No. 4,873,865 and is attached to plate 200. Spring clipmmechanism 230 engages opening 220 when plate 200 is slidably engaged with slot frame 195 thereby providing a means for removably securing plate 200 and fuel sender unit 210 to fuel sender bracket 190. Mounting means 225 comprises an essentially inverted U-shaped clasp which attaches to reservoir 10. Mounting means 225 may further comprise a spring clip mechanism of the type disclosed in U.S. Pat. No. 4,873,865. In a preferred embodiment in accordance with the invention, fuel sender bracket 190 is removably mounted to the exterior of reservoir 10 at either side wall section 50 or 60 by mounting means 225. It is to be understood that mounting means 225 attaches to reservoir 10 whether reservoir 10 is bottom mounted to fuel tank 12 or unitary with fuel tank 12.

Fuel sender unit 210 is attached to plate 200 which slidably engages slot frame 195 of fuel sender bracket 190 and is fastened by spring clip mechanism 230. Fuel sender bracket 190 is then removably mounted to the exterior of reservoir 10 by mounting means 225 at either side wall section 50 or 60.

Though not limited to a specific fuel tank environment, the reservoir, fuel pump and fuel sender assembly of the present invention may be employed in a fuel tank containing various fuel compositions such as alcohol fuels, for example, combinations of methanol and gasoline, or other fuel compositions. Accordingly, the fuel tank, the reservoir, the fuel pump unit, the fuel pump bracket, the fuel sender unit and the fuel sender bracket may be comprised of materials designed to accommodate alcohol fuels or other fuel compositions. Preferably, the fuel tank is comprised of the same or similar materials comprising the reservoir. One embodiment of the present invention employed in a fuel tank containing an alcohol fuel is comprised of a fuel tank, a reservoir, a fuel pump bracket, and a fuel sender bracket, each comprised of a polyethylene material, a polyacetal material or a stainless steel material. The fuel pump unit and the fuel sender unit are also comprised of materials designed to accommodate alcohol fuels or other fuel compositions.

Figure 9:
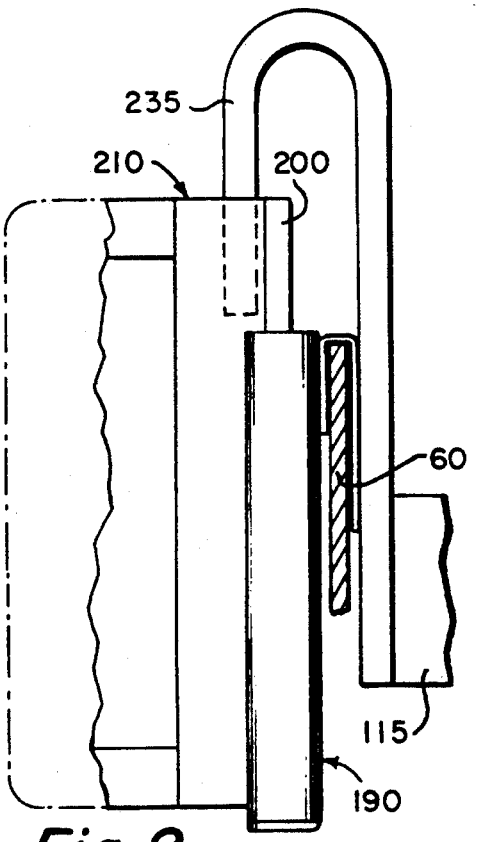
FIG. 9 is a side view, partially in cross section, of a fuel sender bracket and a fuel pump bracket mounted to a reservoir in accordance with a preferred embodiment of the invention.

In addition, the present invention also encompasses within its scope, novel methods for the assembly of a fuel tank assembly comprising a reservoir having a means for mounting the reservoir to a bottom wall section of a fuel tank, a fuel pump unit mounted to the reservoir and a fuel sender unit mounted to the reservoir. In accordance with methods of the present invention, reservoir 10 is mounted to fuel tank 12 preferably at its bottom by any of the mounting means previously mentioned. Fuel pump unit 140 is preferably secured to fuel pump bracket 115, as previously discussed, exterior to fuel tank 12. Fuel sender unit 210 is preferably secured to fuel sender bracket 190, as previously discussed, exterior to fuel tank 12. Fuel sender bracket 190 is then inserted into fuel tank 12 and mounted to reservoir 10. Preferably, fuel sender bracket 190 is removably suspended from side wall section 60 at opening 30 exterior to reservoir 10 by inverted U-shaped clasp 225. Fuel pump bracket 115 is then inserted into fuel tank 12 and mounted to reservoir 10. Preferably, fuel pump bracket 190 is removably suspended from side wall sections 50 and 60, back wall section 80 and front wall section 75 at opening 30 and into reservoir interior 20 by inverted U-shaped clasps 155, 160, 135, and 130 respectively. As indicated in FIG. 9, a preferred orientation depicts an inverted U-shaped clasp 235 of fuel pump bracket 115 overlapping plate 200, fuel sender bracket 190 and side wall section 60. U-shaped clasp 235 may extend into a recess in fuel sender unit 210. This arrangement allows the removal of fuel pump bracket 115 without removing fuel sender bracket 190.

It is to be understood that the embodiments of the present invention which have been described are merely illustrative of applications of the principles of the present invention. Numerous modifications may be made by those skilled in the art without departing from the true spirit and scope of the invention and all such modifications are intended to be within the scope of the appended claims.

What is claimed is:

1. A fuel tank assembly comprising:

a reservoir having means for mounting said reservoir to a bottom wall of a fuel tank;

a fuel pump unit mounted to said reservoir; and a fuel sender unit mounted to said reservoir such that said fuel sender unit moves in direct relation to said bottom wall of said fuel tank to enable an accurate fuel level reading and such that said fuel pump unit and said fuel sender unit are separately removably mounted to said reservoir to enable separate removal of said fuel pump unit or said fuel sender unit from said fuel tank.

2. A fuel tank assembly comprising:

a fuel tank;

a reservoir having means for mounting said reservoir to a bottom wall of said fuel tank;

a fuel pump unit mounted to said reservoir; and a fuel sender unit mounted to said reservoir such that said fuel sender unit moves in direct relation to said bottom wall of said fuel tank to enable an accurate fuel level reading and such that said fuel pump unit and said fuel sender unit are separately removably mounted to said reservoir to enable separate removal of said fuel pump unit or said fuel sender unit from said fuel tank.

3. The fuel tank assembly of claim 1 wherein said reservoir is generally boot-shaped and comprises a substantially planar bottom wall section, side wall sections integral with and extending substantially vertically from said bottom wall section, a back wall section integral with said side wall sections and said bottom wall section and extending substantially vertically from said bottom wall section, and a front wall section integral with said bottom wall section and said side wall sections, said front wall section being angled towards said back wall section and terminating vertically, said front wall section, said side wall sections and said back wall section cooperating to form a reservoir opening.

4. The fuel tank assembly of claim 1, wherein said reservoir comprises a tubular fuel passage conduit having a first opening positioned near said back wall section and said bottom wall section, said fuel passage conduit wrapping around one of said side wall sections, said front wall section and engaging the other of said side wall sections at an opening providing fluid communication for a flow of fuel through said fuel passage conduit into said reservoir

5. The fuel tank assembly of claim 1 wherein said means for mounting said reservoir comprises protrusions fixedly mounted to said reservoir and securing means for securing said means for mounting said reservoir to said fuel tank bottom comprising fittings which engage said means for mounting and are fixedly secured to said fuel tank bottom.

6. The fuel tank assembly of claim 1 wherein said fuel pump unit is mounted within said reservoir by a fuel pump bracket comprising a cradle means for supporting said fuel pump unit, support means for removably attaching said fuel pump bracket to said reservoir, and strap means for removably securing said fuel pump unit to said fuel pump bracket.

7. A fuel tank assembly comprising:

a reservoir having means for mounting said reservoir to a bottom wall of a fuel tank;

a fuel pump unit mounted to said reservoir; and a fuel sender unit mounted to said reservoir, said fuel pump unit being mounted within said reservoir by a fuel pump bracket comprising a cradle means for supporting said fuel pump unit, support means for removably mounting said fuel pump bracket to said reservoir, and strap means for removably securing said fuel pump unit to said fuel pump bracket, said support means for removably mounting said fuel pump bracket to said reservoir comprising a plurality of inverted U-shaped clasps which attach to said reservoir thereby suspending said fuel pump bracket within said reservoir.

8. The fuel tank assembly of claim 7 wherein said plurality of inverted U-shaped clasps comprise four inverted U-shaped clasps positioned approximately equidistant from each other when attached to said reservoir.

9. The fuel tank assembly of claim 6 wherein said cradle means for supporting said fuel pump unit is comprised of a first section and a second section fixedly mounted to one another.

10. The fuel tank assembly of claim 6 wherein said strap means for removably securing said fuel pump unit to said fuel pump bracket comprises a first strap means end fixedly mounted to said fuel pump bracket and a second strap means end, removably mounted to said fuel pump bracket, whereby said strap means engages said fuel pump unit thus securing said fuel pump unit to said fuel pump bracket.

11. The fuel tank assembly of claim 6 wherein said fuel pump bracket comprises a vibration damping means positioned between said fuel pump unit and said fuel pump bracket where said fuel pump bracket supports said fuel pump unit.

12. The fuel tank assembly of claim wherein said fuel sender unit is mounted to a side wall of said reservoir and exterior to said reservoir by a fuel sender bracket.

13. The fuel tank assembly of claim 12 wherein said fuel sender bracket is essentially rectangular in design and comprises a mounting means, a back plate and a slot frame for slidably engaging a plate secured to said fuel sender unit.

14. The fuel tank assembly of claim 13 wherein said mounting means comprises an essentially inverted U-shaped clasp which attaches to reservoir 10.

15. The fuel tank assembly of claim 13 wherein said back plate has an opening for receiving a spring clip mechanism attached to said plate secured to said fuel sender unit.

16. A fuel tank assembly comprising:

a boot-shaped reservoir having a means for mounting said reservoir to a bottom wall of a fuel tank;

a fuel pump unit mounted within said reservoir by a fuel pump bracket comprising a cradle means for supporting said fuel pump unit, support means for removably attaching said fuel pump bracket to said reservoir comprising a plurality of inverted U-shaped clasps which attach to said reservoir thereby suspending said fuel pump bracket within said reservoir, and strap means for removably securing said fuel pump unit to said fuel pump bracket comprising a first strap means end fixedly mounted to said fuel pump bracket and a second strap means end removably mounted to said fuel pump bracket, whereby said strap means engages said fuel pump unit thus securing said fuel pump unit to said fuel pump bracket, said fuel pump bracket further comprising a vibration damping means positioned between said fuel pump unit and said fuel pump bracket where said fuel pump bracket supports said fuel pump unit; and a fuel sender unit mounted to a side wall of said reservoir and exterior to said reservoir by a fuel sender bracket of essentially rectangular design comprising a mounting means comprising an essentially inverted U-shaped clasp, a back plate and a slot frame for slidably engaging a plate secured to said fuel sender unit, said back plate having an opening for receiving a spring clip mechanism attached to said plate.

17. A fuel tank assembly comprising:

a fuel tank;

a boot-shaped reservoir having a means for mounting said reservoir to a bottom wall of said fuel tank;

a fuel pump unit mounted within said reservoir by a fuel pump bracket comprising a cradle means for supporting said fuel pump unit, support means for removably attaching said fuel pump bracket to said reservoir comprising a plurality of inverted U-shaped clasps which attach to said reservoir thereby suspending said fuel pump bracket within said reservoir, and strap means for removably securing said fuel pump unit to said fuel pump bracket comprising a first strap means end fixedly mounted to said fuel pump bracket and a second strap means end removably mounted to said fuel pump bracket, whereby said strap means engages said fuel pump unit thus securing said fuel pump unit to said fuel pump bracket, said fuel pump bracket further comprising a vibration damping means positioned between said fuel pump unit and said fuel pump bracket where said fuel pump bracket supports said fuel pump unit; and a fuel sender unit mounted to a side wall of said reservoir and exterior to said reservoir by a fuel sender bracket of essentially rectangular design comprising a mounting means comprising an essentially inverted U-shaped clasp, a back plate and a slot frame for slidably engaging a plate secured to said fuel sender unit, said back plate having an opening for receiving a spring clip mechanism attached to said plate.

18. The fuel tank assembly of claim 1 wherein said reservoir is comprised of a material selected from the group consisting of polyethylene, polyacetal and stainless steel, said fuel pump unit is mounted to said reservoir by a fuel pump bracket comprised of a material selected from the group consisting of polyethylene, polyacetal and stainless steel, and said fuel sender unit is mounted to said reservoir by a fuel sender bracket comprised of a material selected from the group consisting of polyethylene, polyacetal and stainless steel.

19. The fuel tank assembly of claim 16 wherein said boot-shaped reservoir is comprised of a material selected from the group consisting of polyethylene, polyacetal and stainless steel, said fuel pump bracket is comprised of a material selected from the group consisting of polyethylene, polyacetal and stainless steel and said fuel sender bracket is comprised of a material selected from the group consisting of polyethylene, polyacetal and stainless steel.

20. The fuel tank assembly of claim 17 wherein said fuel tank is comprised of a material selected from the group consisting of polyethylene, polyacetal and stainless steel, said boot-shaped reservoir is comprised of a material selected from the group consisting of polyethylene, polyacetal and stainless steel, said fuel pump bracket is comprised of a material selected from the group consisting of polyethylene, polyacetal and stainless steel and said fuel sender bracket is comprised of a material selected from the group consisting of polyethylene, polyacetal and stainless steel.

21. A method of assembling a fuel tank assembly for placement within a fuel tank comprising the steps of removably mounting a fuel sender unit to a reservoir by a removable fuel sender bracket, and removably mounting a fuel pump unit to said reservoir by a removable fuel pump bracket such that said fuel sender unit moves in direct relation to said reservoir to enable an accurate fuel level reading and such that said fuel pump unit and said fuel sender unit are separately removably mounted to said reservoir to enable separate removal of said fuel pump unit or said fuel sender unit form said fuel tank.

22. The method of claim 21 wherein said fuel pump bracket overlaps said fuel sender bracket and is removable without removing said fuel sender bracket.

* * * * *